US007377095B2

(12) United States Patent
Wassenhoven et al.

(10) Patent No.: US 7,377,095 B2
(45) Date of Patent: May 27, 2008

(54) OPEN-END SPINNING DEVICE

(75) Inventors: Heinz-Georg Wassenhoven, Mönchengladbach (DE); Georg Schmidt, Mönchengladbach (DE); Norbert Coenen, Mönchengladbach (DE); Friedhelm Mistler, Wegberg (DE); Stephan Bühren, Schwalmtal (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 170 days.

(21) Appl. No.: 10/570,036

(22) PCT Filed: Jul. 6, 2004

(86) PCT No.: PCT/EP2004/007341

§ 371 (c)(1),
(2), (4) Date: Feb. 28, 2006

(87) PCT Pub. No.: WO2005/033385

PCT Pub. Date: Apr. 14, 2005

(65) Prior Publication Data

US 2007/0130908 A1 Jun. 14, 2007

(30) Foreign Application Priority Data

Sep. 4, 2003 (DE) ..... 103 40 657

(51) Int. Cl.
*D01H 4/08* (2006.01)

(52) U.S. Cl. ..... 57/406

(58) Field of Classification Search ..... 57/406, 57/407

See application file for complete search history.

(56) References Cited

U.S. PATENT DOCUMENTS

| | | | | |
|---|---|---|---|---|
| 3,922,840 | A * | 12/1975 | Watanabe et al. | 57/407 |
| 3,972,171 | A | 8/1976 | Handschuch et al. | 57/58.89 |
| 4,122,655 | A * | 10/1978 | Anderson et al. | 57/407 |
| 4,516,396 | A | 5/1985 | Stahlecker et al. | 57/407 |
| 5,647,196 | A * | 7/1997 | Wassenhoven | 57/301 |
| 5,755,087 | A * | 5/1998 | Biller et al. | 57/414 |
| 6,082,090 | A | 7/2000 | Wassenhoven et al. | 57/406 |
| 6,124,658 | A | 9/2000 | Coenen | 310/90.5 |
| 2002/0033013 | A1 | 3/2002 | Wassenhoven | 57/406 |

FOREIGN PATENT DOCUMENTS

| | | |
|---|---|---|
| DE | 21 30 688 | 1/1973 |
| DE | 3247411 A1 | 6/1984 |
| DE | 197 17 737 A1 | 10/1998 |
| DE | EP 0 972 868 A2 | 1/2000 |
| DE | EP 1 188 850 A2 | 3/2002 |

* cited by examiner

*Primary Examiner*—Shaun R. Hurley
(74) *Attorney, Agent, or Firm*—Kennedy Covington Lobdell & Hickman, LLP

(57) ABSTRACT

The invention relates to an open end spinning device comprising a single-motor driven spinning rotor whose cup is rotationally actuated in the rotor housing which is negatively pressurized and closed by a cover element during a spinning process. According to said invention, the rotor house (2) is embodied in the form of a central element which is fixable to the frame of a textile machine and connects the control (3) of the spinning rotor (21) to the carrier (4) for the cover element (6) provided with a fibre band releasing device (23).

9 Claims, 4 Drawing Sheets

OPEN-END SPINNING DEVICE

BACKGROUND OF THE INVENTION

This application claims the benefit of German patent application 10340657.3 filed Sep. 4, 2003, herein incorporated by reference.

The invention relates to an open-end spinning device with a spinning rotor, which can be driven by an individual motor and whose rotor cup rotates in the rotor housing to which an underpressure can be applied and which can be closed by means of a cover element during the spinning process.

Such open-end spinning devices are known in various embodiments in connection with rotor spinning devices and have been described in numerous patent applications.

For example, open-end spinning devices have been known for a long time, wherein the different spinning components are arranged in a spinning box frame which, in turn, has been assembled from several individual components.

These known open-end spinning devices, which have for example been described in German Patent Publication DE 32 47 411 C2, have a spinning box frame which consists of at least two lateral frames, which can be fixed in place on the base element of a spinning device, at least two upper bracing elements, as well as at least one lower spacing device.

Here, the lateral frames and the bracing elements are connected with each other by means of a plurality of threaded bolts, wherein the individual components are aligned via fitting bore/fitting pin connections in an elaborate manner.

In connection with such open-end spinning devices, the large number of fitting bores which are required to exactly connect the spinning box frame is disadvantageous inter alia. Moreover, in regard to screw connections there is always the danger that they come loose over time because of the vibrations during the running of the textile machine.

This means that no sufficient rigidity of a spinning box frame with screw connections of this type can be assured over time which, in addition to the rotor seating, must contain the sliver opening device, as well as a cover element for closing off the rotor housing during the spinning operations.

To avoid the above mentioned disadvantages, a shift has been made toward the permanent connection of the various components of such spinning box frames by arc welding.

However, with arc welding there is the danger that, because of heating over large surfaces of the parts to be welded together, warping as a result of thermal stressing of the individual components can occur. The components must therefore be aligned again after welding before the bores for the fitted alignment of the various spinning components can be drilled.

For avoiding such thermal stresses because of heating it has already been proposed to connect the individual components of the spinning box frame by laser welding. German Patent Publication DE 19717 737 A1 describes such spinning box frames, whose components have been connected by means of a laser connecting process.

Since with this method the energy used can be exactly metered, and the area of heat supply can be very exactly localized, no heat effects over large areas of the involved components arise. No warping of the spinning box frame occurs with this method.

However, a spinning box frame by itself already constitutes a relatively expensive component, which is merely used for seating the various spinning components of an open-end spinning device in an exactly positioned manner and for fixing it in place on a machine frame of a textile machine. It has therefore already been attempted in the past to position the spinning components of an open-end spinning device on a textile machine without a special spinning box frame being employed.

German Patent Publication DE 2130 688 A1 describes such an open-end spinning device.

With this known open-end spinning device, the spinning components, some of which are independent of each other to the greatest extent, have been mounted directly on a linear support of the machine base frame of a textile machine. In this case the rotor housing is fixed in place on the upper leg of a U-shaped leg by means of lateral flanges and has a rear cutout, in which a spinning rotor driven by a single motor is seated.

The front of the rotor housing can be closed by means of a cover, which in turn is pivotably seated on the rotor housing.

A sliver opening device is fastened, spaced apart from the rotor housing, on the front of the lower leg of the U-shaped support and is functionally connected with the rotor housing via a fiber guide channel.

However, the selected separated arrangement of the spinning components has not shown itself to be very advantageous during the spinning operation, so that these known open-end spinning devices were never capable of being accepted in actual use.

SUMMARY OF THE INVENTION

Based on the above mentioned prior art, it is the object of the instant invention to develop an open-end spinning device which, on the one hand, can be produced in a cost-effective manner, and by means of which, on the other hand, it is assured that the different spinning components can be exactly positioned.

This object of the invention is attained by means of an open-end spinning device basically having a spinning rotor, which can be driven by an individual motor and whose rotor cup rotates in the rotor housing to which an underpressure can be applied and which can be closed by means of a cover element during the spinning process. According to the present invention, the rotor housing is embodied as a central component, which can be fixed in place on the machine frame of a textile machine, to which the drive mechanism of the spinning rotor, as well as a cover element having supports for a sliver opening device can be connected.

Advantageous embodiments of the invention are described below.

By embodying the rotor housing in the form of a central supporting component, the embodiment in accordance with the invention has the advantage that it possible to completely do without a complex spinning box frame for positioning the various spinning components.

This means that in accordance with the present invention the rotor housing, which can be fixed in place releasably on the machine frame of the textile machine, for example by means of fastening tongues, constitutes the bearing backbone of the open-end spinning device in accordance with the invention, to which the other spinning components are attached.

The single-motor drive mechanism for the spinning rotor is directly screwed on the rotor housing which rotor housing is preferably embodied as a cast part made of a metallic material with good heat conductivity. Such an arrangement furthermore has the advantage that the conveying air which pneumatically transports the fibers from the opening device to the spinning rotor and flows through the rotor housing, simultaneously also cools the drive mechanism of the spinning rotor.

Since furthermore the supports for a cover element having a sliver opening device are fastened on the rotor housing, the embodiment in accordance with the invention as a whole represents a cost-effective and extremely compact construction.

The embodiment in accordance with the invention also assures that the spatial association of the individual spinning components is most accurately maintained and, for example during an exchange of individual spinning components, is reproducible at any time which, in the interest of a good spinning results, is extremely important.

As already indicated above, the rotor housing in an advantageous embodiment is preferably designed as a cast element, wherein aluminum, for example, is used as a preferred metallic material. Such a manufacturing process makes it possible to produce mass-produced parts in particular, cost effectively and exactly fitted.

The embodiment with a magnetic bearing for the spinning rotor which is seated in a contactless manner integrated into the rotor housing, has proven itself to be extremely advantageous.

By means of such an arrangement it is assured in a simple way that the spinning rotor always takes up an exactly defined position in relation to the rotor housing.

In this case no adjustment work or the like is necessary when installing the spinning rotor.

The housing of the electromagnetic drive mechanism of the spinning rotor, which also contains the rear magnetic bearing for the spinning rotor, can be fixed in place on the rotor housing via threaded bolts, which penetrate the rear wall of the motor housing from the front.

The front magnetic bearing integrated into the rotor housing at the same time constitutes a centering shoulder, on which the housing of the drive mechanism of the spinning rotor can be exactly positioned.

A housing for the electronic control device of the spinning rotor drive mechanism is furthermore provided. This housing is directly connected with the housing of the spinning rotor drive mechanism.

The construction of the open-end spinning device which, as a whole, is very compact, is also aided by means of this arrangement.

In an advantageous embodiment the supports on which the cover element having the sliver opening device is seated, limited in some degree and removable, are also produced as cast elements. As already described above in connection with the rotor housing, such a manufacturing process offers the chance of producing mass-produced elements with exact fit and cost-effectively.

The supports, which can be fixed in place on the rotor housing, preferably consist of a metallic material, for example aluminum.

In this case the separately produced supports, which are provided with fitting bores, can be fixed in place on the rotor housing by means of appropriate centering pins, as well as threaded bolts in an exactly fitted way, and then constitute a quasi one-piece element together with the rotor housing, with a pivot axis exactly positioned in respect to the spinning rotor shaft.

Therefore the spinning components arranged in the cover element can also always be exactly positioned in respect to the spinning rotor shaft.

The sliding bushings arranged in corresponding bearings of the supports correspond in a known manner to adjustable journals on the cover element and thus make possible easy pivoting of the cover element into the open and closed position, as well as also a rapid and problem-free exchange of this component when needed.

BRIEF DESCRIPTION OF THE DRAWINGS

The invention will be explained in what follows by means of an exemplary embodiment represented in the drawings.

Shown are in.

DETAILED DESCRIPTION OF THE PREFERRED EMBODIMENT

Figure 1:
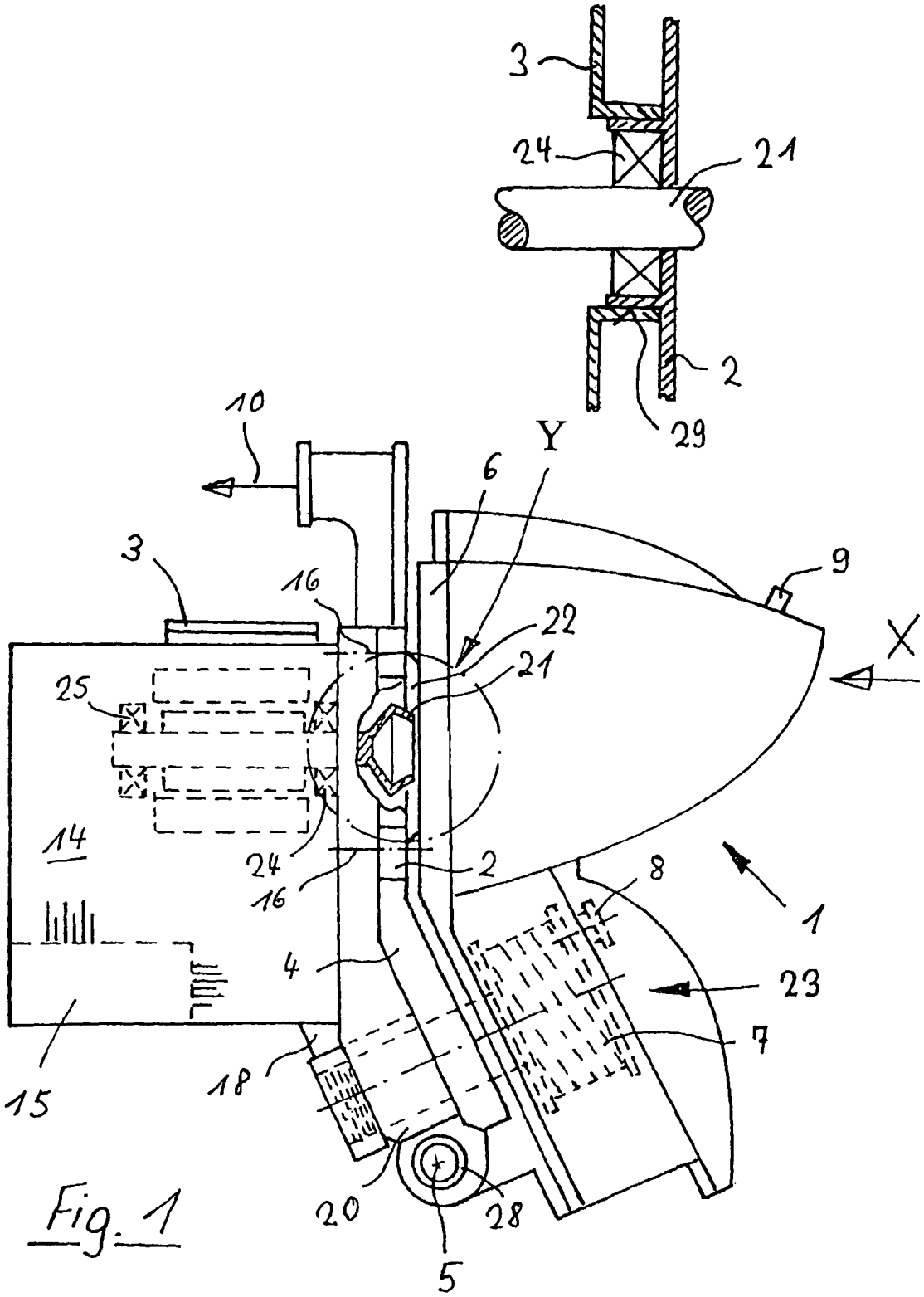
FIG. 1, a lateral view of an open-end spinning device in accordance with the invention, FIG. 2, a lateral view of the opposite side on the open-end spinning device represented in FIG. 1, FIG. 3, rear view of the open-end spinning device, FIG. 4, the rotor housing of the open-end spinning device with flanged-on support arms.
Figure 2:
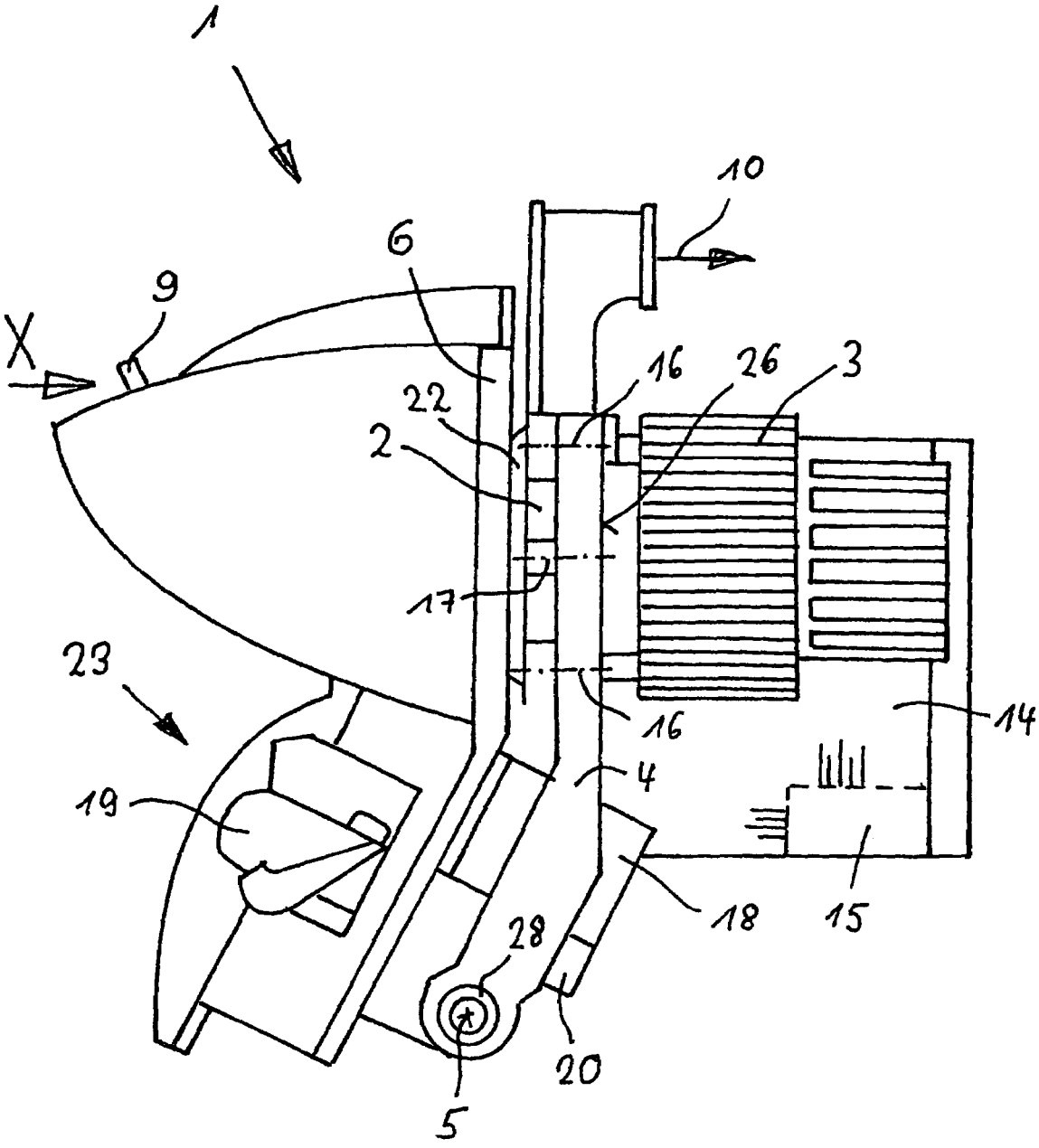
Figure 3:
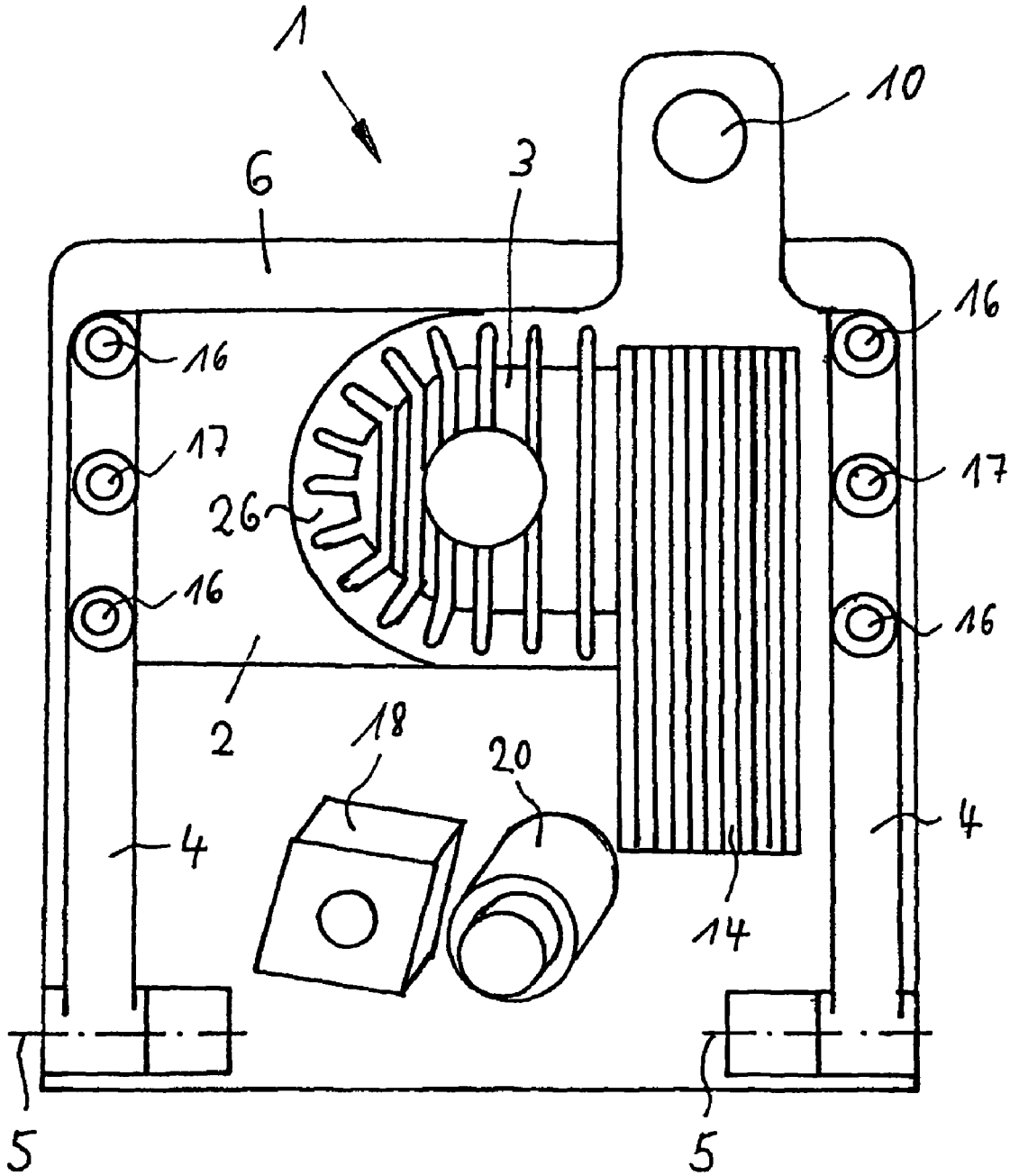

The open-end spinning device in accordance with the invention is represented in several views in FIGS. 1 to 3. Here, FIG. 1 shows the left side in the viewing direction X, FIG. 2 the right side in the viewing direction X, and FIG. 3 the rear of the open-end spinning device.

As the central supporting component, the open-end spinning device 1 has a rotor housing 2 made of a metal with good heat conducting properties, for example aluminum, on which exactly fitting supports 4 have been fixed in place by means of fitting bolts 16, or threaded bolts 17. On their ends, these supports 4, each designed for example as bearing arms, have a bearing equipped with sliding bushings 28, which constitute a pivot shaft 5 a cover element 6.

The cover element 6, which closes the rotor housing 6 during spinning operations, has an annular seal 22 for this purpose, which rests against the front wall of the rotor housing 2.

A sliver opening device 23 is furthermore integrated into the cover element 6 which has, as schematically indicated, an opening roller 7 driven by an individual motor, as well as a sliver draw-in cylinder 8, also driven by an individual motor.

Moreover, the housing of the drive mechanism 3 for the spinning rotor 21, whose rotor cup rotates in the rotor housing 2 to which an underpressure can be applied, has been fixed in place on the rear 26 of the rotor housing 2.

Here, the spinning rotor 21, which is driven by an individual motor, is supported in a contactless manner by means of magnetic bearings 24, 25.

Such spinning rotors, driven and seated in this manner, are known in principle and have been described relatively extensively, for example in EP 0 972 868 A2.

A housing 14 is connected to the housing of the spinning rotor drive mechanism 3, which contains the electronic control device 15 for the drive mechanism 3. In this case the electronic control device 15 assures that the spinning rotor 21 always rotates at a prescribed number of revolutions. The rotor housing 2 is furthermore connected in the customary manner via a pneumatic line 10 to a (not represented) underpressure source, which makes the underpressure needed during the spinning process available.

As indicated in FIGS. 2 and 3, the spinning rotor drive mechanism 3 is arranged on the rear wall 26 of the rotor housing 2, and extends over a centering shoulder 29 in the area of the rear wall 26 of the rotor housing 2, as can be seen in particular by means of the detail Y in FIG. 1. The front magnetic bearing 24 for the contactless seated spinning rotor 21 is also integrated in this centering shoulder 29.

The yarn (not represented) produced during the spinning process in the open-end spinning device 1 is drawn-off the open-end spinning device 1 through a small yarn draw-off tube 9 and is subsequently wound into a cheese by means of a known winding device (not represented).

As can be furthermore seen from FIG. 2, in addition a sliver condenser 19 is arranged in the customary manner on the cover element 6, through which the (not represented) sliver is conducted to the sliver opening device 23. Moreover, the drive mechanism 18 for the sliver draw-in cylinder 8, as well as the seating bracket 20 for the opening roller 7, can be schematically seen in this view.

A rear view of the open-end spinning device 1 in accordance with the invention is represented in FIG. 3. As indicated, and already mentioned above, supports 4 have been flanged to the rotor housing 2 by means of fitting pins 16 and threaded bolts 17. At their ends, the supports 4 have a pivot shaft 5 for the cover element 6, which closes the rotor housing 2, which can be charged with an underpressure, during the spinning operation.

Moreover, the drive mechanism 3 for the spinning rotor 21 can be seen on the rear wall 26 of the rotor housing, which in turn is connected with the housing 14 for the electronic control device 15.

The rear wall of the cover element 6 is visible below the drive mechanism 3. The individual drive mechanism 18 for the sliver draw-in cylinder 8, as well as the bearing bracket 20 for the opening roller 7 embodied as an external roller, are arranged at this rear wall of the cover element 6.

Figure 4:
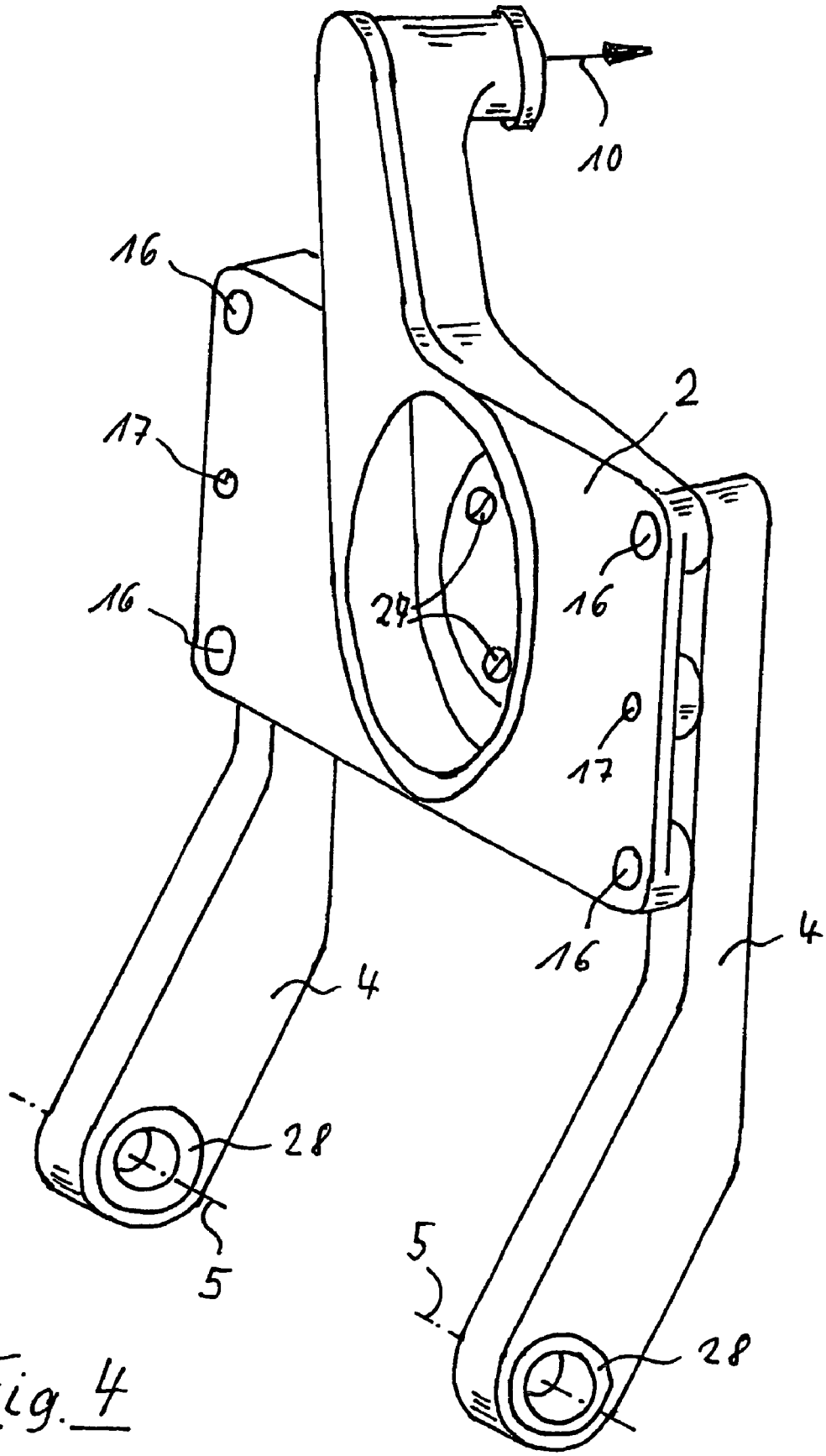

FIG. 4 shows a perspective representation of the rotor housing 2, which is embodied as a central supporting component and preferably made of aluminum.

As can be seen, in the outer area of the rear of the rotor housing 2, supports 4 have been exactly fitted in place by fitting pins 16, or threaded bolts 17.

As furthermore indicated, bores have been furthermore inserted in the rear wall 26 of the rotor housing 2 in the area of the centering shoulder 29, in which threaded bolts 27 can be fixed in place, which arrest the drive mechanism 3 of the spinning rotor 21 in place on the rotor housing 2.

The invention claimed is:

1. An open-end spinning device comprising a rotor housing (2) to which an underpressure can be applied during the spinning process, a spinning rotor (21), driven by a drive mechanism (3) having an individual motor and including a rotor cup which rotates in the rotor housing, and a cover element (6) for closing the rotor housing during the spinning process, the cover element (6) having supports (4) for a sliver opening device (23), wherein the rotor housing (2) is embodied as a central component of the spinning device and is configured for mounting in a fixed disposition on a machine frame of a textile machine and for mounting to the rotor housing of the drive mechanism (3) of the spinning rotor (21) and the cover element (6) with the supports (4) thereof for the sliver opening device (23).

2. The open-end spinning device in accordance with claim 1, characterized in that the rotor housing (2) is made of a metallic material with good heat-conducting properties.

3. The open-end spinning device in accordance with claim 1, characterized in that the rotor house (2) is embodied as a cast part.

4. The open-end spinning device in accordance with claim 1, characterized in that the spinning rotor (21) is seated in a contactless manner, and one of the magnetic bearings (24, 25) is integrated into the rotor housing (2).

5. The open-end spinning device in accordance with claim 1, characterized in that the drive mechanism (3) for the spinning rotor (21) is fixed in place on the rear wall (26) of the rotor housing (2) and is secured by threaded bolts (27), which are accessible through the opened rotor housing (2).

6. The open-end spinning device in accordance with claim 1, characterized in that the housing of the drive mechanism (3) of the spinning rotor (21) is mechanically connected with a housing (14), which contains the electronic control device (15) for the drive mechanism (3).

7. The open-end spinning device in accordance with claim 1, characterized in that the bearing arms (4) for the cover element (6) have been manufactured as cast parts.

8. The open-end spinning device in accordance with claim 7, characterized in that the bearing arms (4) can be fixed in place in the rotor housing (2) in an exactly fitting manner by means of centering pins (16) as well a threaded bolts (17).

9. The open-end spinning device in accordance with claim 7, characterized in that sliding bushings (28) are arranged in the ends of the support arms (4), which constitute a pivot shaft (5) for the releasably arranged cover element.

* * * * *